United States Patent [19]

Busch et al.

[11] 4,081,952

[45] Apr. 4, 1978

[54] WATCH MODULE FOR USE WITH SEPARATE POWER SOURCE

[75] Inventors: Rudolf Busch; Wolfgang Ganter, both of Schramberg; Albert Ginter, Lauterbach, all of Germany

[73] Assignee: Gebruder Junghans GmbH, Schramberg, Germany

[21] Appl. No.: 705,613

[22] Filed: Jul. 15, 1976

[30] Foreign Application Priority Data

Apr. 24, 1976 Germany ..... 2618097

[51] Int. Cl.[2] ..... G04C 3/00

[52] U.S. Cl. ..... 58/50 R; 58/23 BA; 58/88 R

[58] Field of Search ..... 58/23 BA, 50 R, 88 R; D10/15, 22

[56] References Cited

U.S. PATENT DOCUMENTS

| | | | |
|---|---|---|---|
| D. 223,628 | 5/1972 | Watanabe | D10/15 |
| D. 241,522 | 9/1976 | Tateishi | D10/15 |
| 2,726,571 | 12/1955 | Chang | 58/50 R |
| 2,974,474 | 3/1961 | Wegner | 58/50 R |
| 3,586,848 | 6/1971 | Loftis | 240/2.1 |
| 3,762,152 | 10/1973 | Marl | 58/23 R |
| 3,885,381 | 5/1975 | Kasai et al. | 58/23 BA |
| 3,986,335 | 10/1976 | Harper | 58/50 R |

*Primary Examiner*—Robert K. Schaefer
*Assistant Examiner*—Vit W. Miska
*Attorney, Agent, or Firm*—Burns, Doane, Swecker & Mathis

[57] ABSTRACT

A clock module for use with a separate power source comprises an electrical operating assembly contained within a rod-shaped housing. The operating assembly includes a digital recorder and an adjusting member therefor, a time keeping oscillator, integrated electrical circuitry and an electrical contact. The housing, preferably in the form of a circular cylinder, includes a longitudinal side portion and opposite end portions. The digital recorder is situated along the side portion of the housing. The electrical contact is situated at one end portion of the housing. The adjusting member is situated at the longitudinal side portion of the housing or at the other end portion of the housing.

5 Claims, 4 Drawing Figures

WATCH MODULE FOR USE WITH SEPARATE POWER SOURCE

BACKGROUND AND OBJECTS

The invention relates to a clock module of the type including a digital recorder, a time keeping oscillator, an electronic integrated circuit for operating the digital recorder and contact elements for adjusting the digital recorder.

Clock modules are known which, embedded in a plastic housing, carry all operational elements for actuating the digital recording and the time keeping operation of the digital recorder, and which at the same time accommodate the necessary batteries. Conditional on the batteries being developed essentially in the form of tablets, these modules have a disc-like shape and can be inserted into wrist watch housings of the customary construction.

In German Offenlegungsschriften No. 2,501,234, a wrist watch is known which carries several modules in the manner of a link bracelet, one of which modules carries the recorder elements, another one the current supply, a further one the electronic circuit, etc.

It is an object of the present invention to provide a novel clock module.

It is another object of the invention to provide a novel clock module which is characterized by a novel configuration adapting it to a greater variety of uses.

It is a further object of the invention to provide a novel clock module, the outside form of which is not influenced by the batteries, which constitutes an individually marketable unit, and which affords a great amount of liberty to the designer in the shaping of the module as a wrist watch, as a piece of jewelry or as an insert element into utility or gift articles.

BRIEF DESCRIPTION

At least some of these objects are achieved by the present invention involving a clock module for use with a separate power source. The module comprises an electrical operating assembly and a rod-shaped housing. The electrical operating assembly includes an electrically conductive plate arrangement. The plate arrangement has a digital recorder, adjusting mechanism for adjusting the digital recorder, a time-keeping oscillator, integrated electrical circuitry for supplying electrical energy to the digital recorder, and an electrical contact for connecting the circuitry to the separate source. The rod-shaped housing contains the electrical operating assembly and includes a longitudinal side portion and opposite end portions. The digital recorder is situated along the side portion of the housing. The electrical contact is situated at one end portion of the housing. The adjusting mechanism is situated at the longitudinal side portion of the housing, or at the other end portion of the housing.

THE DRAWING

A preferred embodiment of the present invention is described hereinafter in conjunction with the accompanying drawing in which.

DETAILED DESCRIPTION

Figure 1:
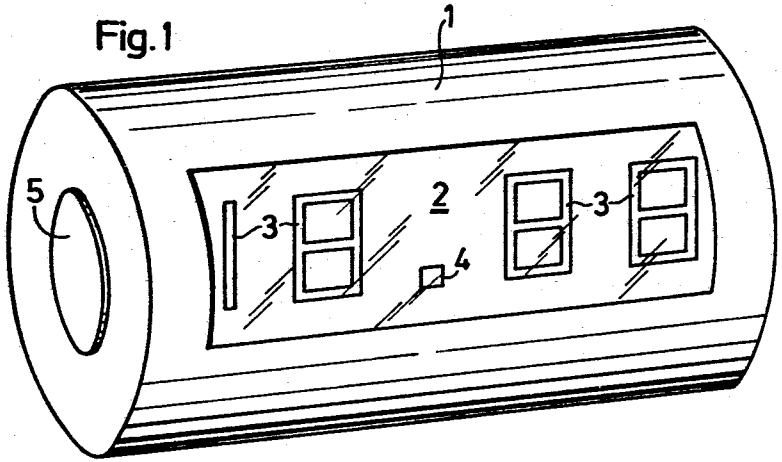
FIG. 1 is an enlarged perspective view of a watch module according to the invention.

In FIG. 1, a watch module according to the invention is shown as including a hollow, circular cylindrical housing 1, preferably formed of metal, which has a glass plate 2 extending longitudinally along its side. Behind the plate 2 is disposed a digital recorder 3 for displaying hours and minutes. One point 4 of the recorder serves for the recording of the operation of the watch by flashing in the second-time. A battery contact 5 is mounted at one end of the housing, which contact 5 is insulated relative to the housing. Within the scope of the invention, it would however also be possible, and especially in the case of use of a plastic housing, to dispose two battery contacts 5 for both battery polarities anywhere on the side of the cylinder, such as in the vicinity of the plate 2, or diametrically opposite the plate 2.

Figure 2:
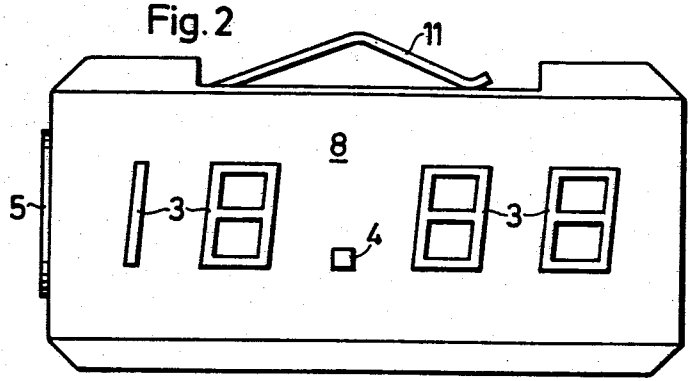
FIG. 2 is a front view of the electrical operating assembly of the module, with the module housing having been removed.
Figure 3:
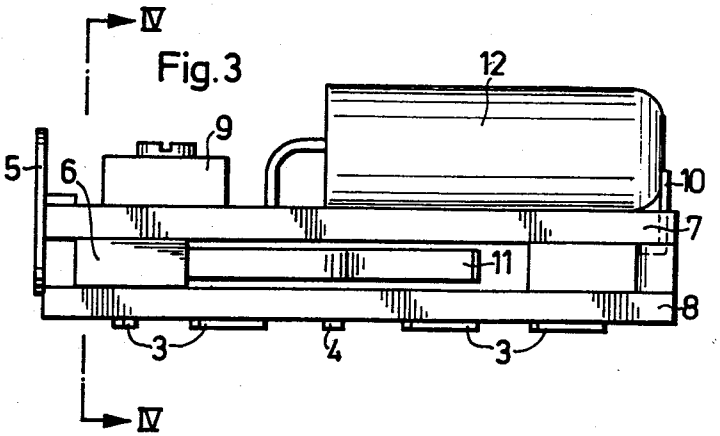
FIG. 3 is a plan view of the electrical operating assembly depicted in FIG. 2.
Figure 4:
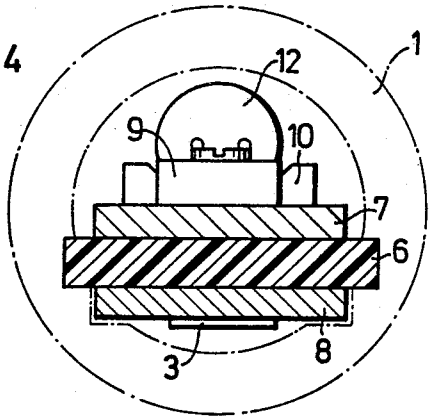
FIG. 4 is a cross sectional view of the electrical operating assembly taken along line IV—IV of FIG. 3.

The contact 5 forms part of the electrical operating assembly for the digital recorder, which assembly is depicted as a unitary cartridge in FIGS. 2–4. A plastic plate 6 functions as a carrier for the various functional elements of the operating element for the electronic construction system. In FIG. 4, in phantom lines, the circumference of the module housing 1 and the arrangement of the carrier plate 6 in the housing can be recognized. A first conductive plate 7 and a second conductive plate 8 are attached to the carrier plate 6. The conductive plate 7 carries an integrated circuit for conducting the pulses of the time keeping element, as well as the driving circuit for the digital recorder. On the conductive plate 7 is additionally mounted a time keeping mechanism comprising a quartz 12, as well as a trimmer 9 for the adjustment of the quartz. Instead of a quartz, some other electronic time keeping construction unit can also be used, such as an RC oscillator for example. The digital recorder, an LED recorder, is attached to the conductive plate 8. The carrier plate 6 carries several pins, not shown in the drawing, which engage both with the conductive plate 7 as well as with the conductive plate 8 and which bring the latter two into electric contact with one another. In addition, the two conductive plates 7, 8 are connected mechanically with the carrier plate 6 by such pins. The previously described layer-like construction of the electronic operating assembly is particularly advantageous for the development of the watch module in rod or cylindrical shape.

The operating assembly also includes a conventional adjusting member 10 connected to the digital recorder and accessible for adjusting the recorder. The already-mentioned battery contact 5, as well as the adjusting member 10, are disposed laterally on the two conductive plates 7 and 8. If desired, the adjusting member 10 could be situated along the side of the housing, rather than at an end. From FIG. 2, one can also recognize that on the side of the electronic construction group, a spring 11 has been provided, which represents a second battery contact and which, for example, can be directly in conductive connection with the module housing 1.

It will be appreciated that the end of the housing carrying the contacts(s) 5 is designed so that another module can be joined electrically or mechanically therewith.

Although depicted as a circular cylinder, the housing 1 can assume any elongate rod-shaped configuration with various cross-sectional shapes.

By shaping the module in a rod-like manner, especially circular cylindrical, a very versatile utilization of the module is made possible in devices where the shape of formerly employed modules made them impracticable. Also, since the battery or batteries are not housed in the module itself, the size, shape and utility of the module is determined independently of battery size. It is thus possible to employ the module in various functional settings from which use of modules was previously restricted.

Also, it is possible for the designer both when sketching wrist watches, or else small alarm clocks to attach the battery at a place which, from the point of view of design, compactness, efficiency and/or reliability is favorable and which does not necessarily have to be immediately adjacent to the module. Thus, it is possible to construct watches in a shape considerably deviating from former shapes. Beyond that, the module itself can be formed as an ornament by producing the housing of appropriate material and/or in an artistic shape.

The separate current power supply can be accommodated in a second module, which is also shaped artistically. Finally, it is also possible to employ the watch module of the present invention as an operable construction unit in commodities which already have a battery, such as lighters, pocket calculators, etc., so as to utilize the power from such existing batteries.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A clock module for use with a separate housing structure containing a battery, said module comprising:

an electrical operating assembly including:

a first elongated conductive plate, a digital display mounted on said first plate, a second elongated conductive plate, a time keeping oscillator and an integrated electrical circuit mounted on said second plate, and a main contact for engagement with a battery conductor of said separate structure, connected to said circuit, said first and second plates being insulated from one another, adjusting means for adjusting said digital recorder, and an elongated rod shaped housing surrounding said operating assembly, said housing including a longitudinal side wall portion and opposite end wall portions, said digital display being visibly disposed at said longitudinal side wall portion of said housing, said main contact being disposed on one end wall portion of said elongated housing and being exposed to the exterior of said housing so that said module may be installed within said separate structure, with said main contact being placed in electrical engagement with said battery of said separate structure.

2. A module according to claim 1 wherein said rod-shaped housing is of circular cylindrical configuration.

3. A module according to claim 1 wherein said housing is electrically conductive and is insulated relative to said main contact; and further including an additional contact in the form of a spring electrically connected to said circuit and contacting an inner face of said rod shaped housing.

4. A clock module according to claim 1, wherein said first conductive plate has opposed first and second faces, said digital display being carried by said first face; said second conductive plate having opposed first and second faces, said oscillator being mounted on said first face of said second plate, an insulative plate connected between said second faces of said first and second plates, and conductors extending through said insulative plate to connect said circuit with said digital display.

5. A module according to claim 4 wherein said conductors mechanically connect said first and second plates together.

* * * * *